US005853561A

United States Patent [19]

Banks

[11] Patent Number: 5,853,561

[45] Date of Patent: Dec. 29, 1998

[54] METHOD FOR SURFACE TEXTURING TITANIUM PRODUCTS

[75] Inventor: Bruce A. Banks, Olmstead Township, Ohio

[73] Assignee: The United States of America as represented by the Administrator of the National Aeronautics and Space Administration, Washington, D.C.

[21] Appl. No.: 999,562

[22] Filed: Jun. 23, 1997

[51] Int. Cl.[6] ..... C25F 3/08

[52] U.S. Cl. ..... 205/646; 205/650; 205/660; 205/661; 205/665; 205/671; 205/674; 205/686

[58] Field of Search ..... 205/671, 674, 205/660, 661, 686, 665

[56] References Cited

U.S. PATENT DOCUMENTS

| | | | |
|---|---|---|---|
| 3,331,760 | 7/1967 | Powell | 205/671 X |
| 3,411,999 | 11/1968 | Weinberg . | |
| 4,128,463 | 12/1978 | Formanik . | |
| 4,424,433 | 1/1984 | Inoue . | |
| 4,425,204 | 1/1984 | McLaughlin | 205/671 |
| 4,681,665 | 7/1987 | Guillermet et al. . | |
| 5,209,829 | 5/1993 | Gondel et al. . | |
| 5,382,335 | 1/1995 | Jinerec et al. . | |
| 5,409,594 | 4/1995 | Al-Jiboory et al. . | |

*Primary Examiner*—Donald R. Valentine
*Attorney, Agent, or Firm*—Kent N. Stone

[57] ABSTRACT

The present invention teaches a method of producing a textured surface upon an arbitrarily configured titanium or titanium alloy object for the purpose of improving bonding between the object and other materials such as polymer matrix composites and/or human bone for the direct in-growth of orthopaedic implants. The titanium or titanium alloy object is placed in an electrolytic cell having an ultrasonically agitated solution of sodium chloride therein whereby a pattern of uniform "pock mark" like pores or cavities are produced upon the object's surface. The process is very cost effective compared to other methods of producing rough surfaces on titanium and titanium, alloy components. The surface textures produced by the present invention are etched directly into the parent metal at discrete sites separated by areas unaffected by the etching process. Bonding materials to such surface textures on titanium or titanium alloy can thus support a shear load even if adhesion of the bonding material is poor.

19 Claims, 1 Drawing Sheet

METHOD FOR SURFACE TEXTURING TITANIUM PRODUCTS

ORIGIN OF THE INVENTION

The invention described herein was made by an employee of the United States Government and may be manufactured and used by or for the Government for Government purposes without the payment of any royalties thereon or therefor.

BACKGROUND OF THE INVENTION

1. Field of the Invention

The present invention generally relates to an electrochemical process by which the surface of titanium and/or titanium alloy products may be uniformly textured with a pattern of pits or pores. Such a textured surface is particularly suitable for the bonding of graphite epoxy structures to titanium components such as may be required for metal termination of polymer matrix composite beams and/or other structures commonly used in aerospace applications.

More particularly medical implants, typically used for orthopaedic applications, such as spinal fusion implants and/or the stems of hip and knee orthopaedic prostheses may also be textured by the present method to provide for direct bone in-growth fixation of the prostheses.

2. Prior Art

A search of the prior art was conducted and the following related prior art was discovered:

U.S. Pat. No. 3,411,999, teaches electrolytic etching of metal objects immersed in an etchant solution within a glass container which is immersed within a stainless steel tank filed with water. The stainless steel tank is agitated by an ultrasonic transducer whereby the vibrations are transmitted through the glass container to the etchant solution therein. The etchant solution disclosed comprises water and nitric acid, hydrofluoric acid, hydrochloric acid, chromic acid, sulfuric acid, phosphoric acid, glycerol, ethanol, or sodium hydroxide. The object of the disclosed process is to produce smooth etched surfaces.

U.S. Pat. No. 4,128,463, teaches anodic etching assisted by ultrasonic vibrations employing a sodium chloride electrolyte to produce a smooth metal surface.

U.S. Pat. No. 4,424,433, teaches removal of tungsten carbide coatings from titanium and titanium-base alloys by making the workpiece the anode in an electrolytic cell having an electrolyte solution of chromic acid with some sulfate ions. The electrolyte solution is agitated by a mechanical stirrer.

U.S. Pat. No. 4,681,665, teaches a process for anodically treating the surface of metals and alloys of aluminum, magnesium, and titanium. Workpieces are immersed in an elongated electrolytic cell having a plurality of electrodes which are periodically and alternately made electrically positive, neutral, and negative.

U.S. Pat. No. 5,209,829, discloses an improved etching composition and process for treating titanium alloy surfaces to reveal surface imperfections in workpieces such as segregations, inclusions, porosity, cracks, incrustations, and machining and/or polishing defects such as work hardening and local overheating. The workpieces are immersed in a solution of sulfuric acid and sodium fluoride.

U.S. Pat. No. 5,382,335, teaches a process for pickling a continuously moving metal strip, wire, or metal profiles through a series of electrolyte tanks in which the metal strip is alternately made the cathode and the anode of an electrolytic cell.

U.S. Pat. No. 5,409,594, discloses an immersion tank for cleaning workpieces having a cleaning solution that is agitated by ultrasonic transducers.

None of the discovered prior art teaches or otherwise suggests a process that is suitable for providing a "pock marked" or pit textured surface upon the surface of the workpiece. All of the discovered prior art teaches processes by which a smooth surface is obtained or by which some foreign material is stripped from the workpiece surface.

SUMMARY OF THE INVENTION

The present invention discloses and teaches a method by which the surface of titanium and/or titanium alloy objects, having both simple and/or complex configurations, may be electrolytically textured with a pattern of uniformly configured "pock mark" pores, or pits, therein.

The process employs an electrolytic cell wherein the object, or objects, to be textured are immersed within a metal container having a sodium chloride and water solution therein. The objects to be textured (anode) are electrically connected to the positive terminal of a direct current (DC) power source and the metal container (cathode) is electrically connected to the negative terminal of the DC power source. During the electrochemical process the electrolyte is ultrasonically agitated by an ultrasonic transducer.

By the electrochemical process as taught herein, the surface of titanium and/or titanium alloy articles may be uniformly textured with a pattern of pits or pores suitable for the bonding of graphite epoxy structures thereto such as may be desired for the metal alloy termination of polymer matrix composite beams and other similar structures commonly used in aerospace applications. The surface pores generated are shallow but very well defined thus providing ideal structure for supporting sheer loads of the above identified polymer matrix composite materials.

Further the electrochemical process, taught herein, is particularly suitable for texturing orthopaedic products such as spinal fusion implants and/or the stems of hip or knee orthopaedic prostheses to provide for direct bone in-growth fixation of these implants. The size of the surface pores can be controlled thereby providing ideal structure for orthopaedic applications requiring direct bone in-growth. There are no deep pores which would give rise to inadequately nourished in-grown cells.

The process taught herein employs the application of materials which are very bio-compatible, such as sodium chloride and water, and therefore does not introduce materials which are incompatible with surgical implantation in humans. The texturing bath waste products consisting of titanium dioxide are not considered hazardous material.

DETAILED DESCRIPTION OF THE PREFERRED EMBODIMENT

Figure 1:
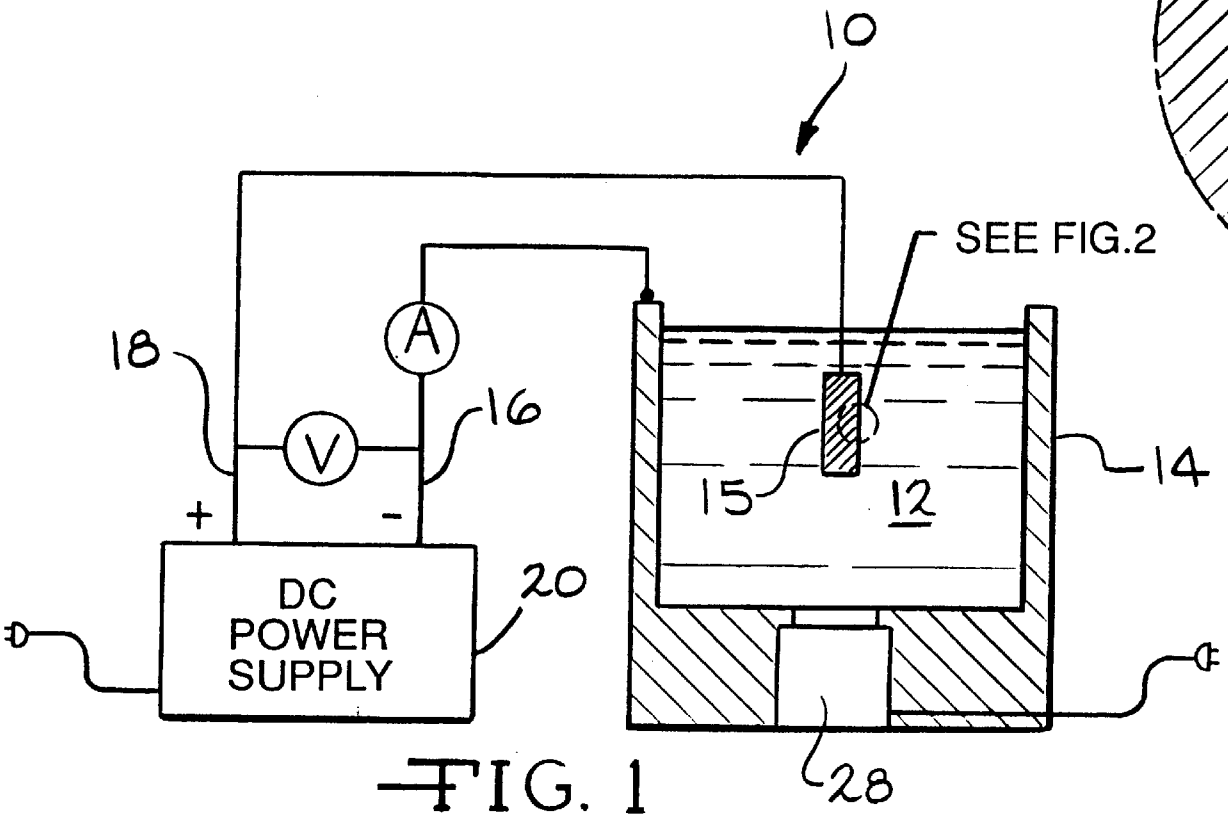
FIG. 1 presents a schematical cross-section view of a typical electrolytic cell suitable for practicing the present invention.

FIG. 1 presents a schematical cross section of electrochemical apparatus suitable for carrying out the present invention. An electrical cell 10 is generally illustrated and comprises an electrically conductive metal tank 14 containing therein a near-saturated solution of water and sodium chloride 12. Such a near-saturated solution has been found to produce a highly textured surface in titanium and titanium alloys such as titanium 6% aluminum 4% vanadium. The preferred electrolyte concentration comprises 35.7 grams of sodium chloride (NaCl) to 100 grams of water (H2O). However, any concentration within the range of 3 grams NaCl to 100 grams of water to 39.12 grams NaCl to 100 grams of water may also be used.

The workpiece 15, upon which the surface is to be textured, is suspended within said sodium chloride bath 12 and electrically connected to the positive terminal 18 of a direct current (DC) power supply 20. Metal tank 14, preferably stainless steel, is electrically connected to the negative terminal 16 of the DC power supply 20 as shown. Thus an electrolytic cell is formed wherein the object 15 to be textured becomes the anode and the metal tank structure 14 becomes the cathode.

Figure 2:
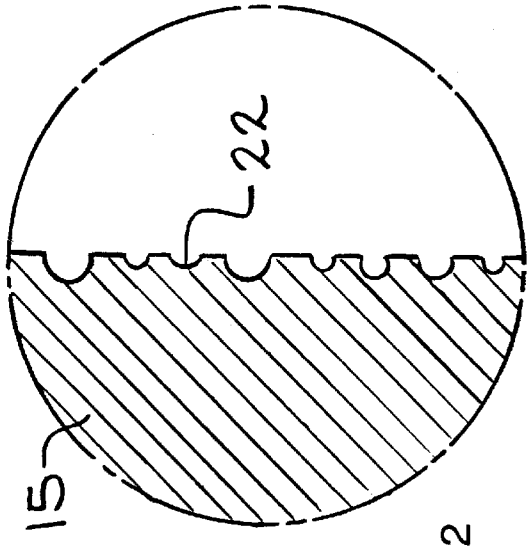
FIG. 2 is an enlarged cross-sectional schematic view showing the typical spatially segregated sites of erosion, otherwise described as a pit textured surface, as etched into the surface of a titanium or titanium alloy workpiece employing the present invention.

An ultrasonic transducer, or vibrator, 28 is provided to introduce ultrasonic vibrations into the water-sodium chloride solution 12 as shown in FIG. 1. It has been found that an applied current density ranging from 1.4 amps/cm2 to 7 amps/cm2 for time periods of between 1 and 3 minutes were ideal for producing surfaces having a relatively uniform distribution of electrochemically etched pock mark cavities or pores as schematically illustrated in FIG. 2.

During the electrochemical texturing process, the ultrasonic agitation of the water-sodium chloride bath prevents titanium dioxide from accumulating on the surfaces of the workpiece 15. By ultrasonicly agitating the bath 12 the texturing process is continued until the desired pock mark density on the surface is achieved. By adjusting the current density, the duration of electrical current application and the initial surface preparation, the size of the surface cavities may be controlled as well as the density of the population.

It may be desirable to pretreat the surface to be textured, either mechanically or chemically, to control the pattern, population density, and/or size of the cavities produced by the electrolytic process. It has been found for example that if the surface being textured is first scored with sand paper or a wire wheel or brush, the electrochemically formed cavities will tend to orient themselves along the score lines. Thus the direction, and/or population density, may be controlled or directed.

Various pre-treatment methods of workpiece 15 may be used. Such surface preparations may, but not necessarily be limited to, include sanding the surface to be textured, abrasively grinding the surface, abrading the surface by grit blasting, coating the surface with a varnish fog which prevents electrochemical action from occurring on selected or random sites on the surface, spraying particles onto the surface which adhesively bond thereto acting as barriers or shields to the electrochemical texturing process, covering the surfaces with a polymer mesh such as a nylon mesh, arc texturing the surface, wire brushing the surface, and/or scraping the surface with metal blades.

Combinations of pre-treatment techniques can also be used, such as applying a mixture of varnish with sodium chloride particles therein followed by an application of atomic oxygen to remove a small amount of the dried varnish, otherwise overlying the salt particles. The exposed sodium chloride particles may then be flushed with water thereby dissolving the sodium chloride particles, and the exposed areas may then be treated to an additional exposure of atomic oxygen whereby the varnish, on the surface being textured, now has small apertures or holes therein, thereby allowing the electrochemical texturing process to take place at the site where the sodium chloride particles were originally located in the varnish-salt mixture as applied.

The electrolyte bath 12 may be heated or chilled and the current may be controlled within the bath by means of dielectric shields (not shown) such that some portions of the workpiece surface receives higher current densities than others. The electrical current may also be cycled on and off as needed in conjunction with the ultrasonic cleaning to assure uniform formation of surface texture on the workpiece surfaces.

Multiple workpieces may be treated in an array within the electrochemical bath whereby multiple workpieces may be textured at the same time. The electrolyte solution 12 may be other than sodium chloride. For example any compound or salt which produces species within the solution which oxidize titanium or titanium alloy materials may also be used. The bath may also include fluid circulation systems to produce desired surface texturing characteristics. The workpieces may also be moved or rotated within the bath as desired for improvements and uniformity of the textured surface. Alternatively the workpiece may be ultrasonicly agitated.

It is evident that many alternatives, modifications, and variations of the present invention will be apparent to those skilled in the art in light of the foregoing teachings. Accordingly, the invention is intended to embrace all such alternatives, modifications and variations as may fall within the spirit and scope of the appended claims.

I claim:

1. A method of texturing the surface of a titanium or titanium alloy workpiece comprising the steps of:

a) providing an electrolytic cell wherein the electrolyte bath within said cell comprises a solution of sodium chloride and water, b) immersing the workpiece, to be textured, within said electrolyte bath, c) electrically connecting said workpiece to the position terminal of a direct current power sour wherein said workpiece becomes the anode of said electrolytic cell, d) providing a cathodic electrode terminal in electrical communication with said electrolyte bath, e) imposing a direct current voltage across the anode and cathode, f) agitating said electrolyte bath wherein said agitations are transmitted through said bath to the surface of said workpiece.

2. The method as claimed in claim 1 wherein the step of agitating said electrolyte bath includes providing an ultrasonic transducer wherein ultrasonic vibrations are introduced to said electrolyte bath.

3. The method as claimed in claim 1 wherein said electrolyte bath comprises a near saturated solution of sodium chloride and water.

4. The method as claimed in claim 1 wherein the current density within said electrolytic cell is within the range of 1.4 amps per square centimeter to 7 amps per square centimeter.

5. The method as claimed in claim 1 wherein the concentration of said electrolyte bath is within the range of 3 grams sodium chloride to 100 grams of water and 39.12 grams of sodium chloride to 100 grams of water.

6. The method as claimed in claim 1 wherein the concentration of said electrolyte bath is 35.7 grams of sodium chloride to 100 grams of water.

7. A method of texturing the surface of a titanium or titanium alloy workpiece with a pattern of pock mark pores comprising the steps of:

a) providing a metal tank, b) filling said metal tank with a near saturated solution of sodium chloride and water, c) immersing the workpiece to be textured within said solution of sodium chloride and water, d) electrically connecting said workpiece to the positive terminal of a direct current power source wherein said workpiece becomes an anode electrode, e) electrically connecting said metal tank to the negative terminal of said direct current power source wherein said tank becomes a cathodic electrode, f) imposing a direct current voltage across said anodic and cathodic electrodes, f) introducing ultrasonic vibrations into said into said solution of sodium chloride and water wherein said vibrations are transmitted through said solution to the surface of said workpiece.

8. The method as claimed in claim 7 wherein the current density within said cell is within the range of 1.4 amps per square centimeter to 7 amps per square centimeter.

9. The method as claimed in claim 8 wherein the concentration of said electrolyte bath is within the range of 3 grams sodium chloride to 100 grams of water and 39.12 grams of sodium chloride to 100 grams of water.

10. The method as claimed in claim 8 wherein the concentration of said electrolyte bath is 35.7 grams of sodium chloride to 100 grams of water.

11. The method as claimed in claim 7 including the step of providing a mechanical pretreatment to the surface of said workpiece.

12. The method as claimed in claim 7 including the step of applying a chemical pretreatment to the surface of said workpiece.

13. The method as claimed in claim 7 including the step of heating said electrolyte bath above ambient temperature.

14. The method as claimed in claim 7 including the step of lowering the temperature of said electrolyte bath below ambient temperature.

15. The method as claimed in claim 7 including the step of cycling the imposed electrical current on and off.

16. The method as claimed in claim 7 including the step of providing a fluid circulation system wherein the electrolyte may be circulated within said tank.

17. The method as claimed in claim 7 including the step of providing dielectric shields within said electrolyte bath wherein certain portions of said workpiece surface receive varying current densities.

18. A method of texturing the surface of a titanium or titanium alloy workpiece comprising the steps of:

a) providing an electrolytic cell wherein the electrolyte bath within said cell comprises a solution of sodium chloride and water, b) immersing the workpiece, to be textured, within said electrolyte bath, c) electrically connecting said workpiece to the positive terminal of a direct current power source wherein said workpiece becomes the anode of said electrolytic cell, d) providing a cathodic electrode terminal in electrical communication with said electrolyte bath, e) imposing a direct current voltage across the anode and cathode, f) agitating said workpiece.

19. The method as claimed in claim 18 wherein said step of agitating said workpiece includes providing an ultrasonic transducer for ultrasonicly vibrating said workpiece.

* * * * *